US006146284A

United States Patent [19]

Russell

[11] Patent Number: 6,146,284

[45] Date of Patent: Nov. 14, 2000

[54] PUTTING GREEN APPARATUS

[76] Inventor: Ian John Russell, Dalvay, 25 Dundee Road, Perth, PH2 7EY, United Kingdom

[21] Appl. No.: 08/952,564

[22] PCT Filed: May 3, 1996

[86] PCT No.: PCT/GB96/01067

§ 371 Date: Oct. 29, 1997

§ 102(e) Date: Oct. 29, 1997

[87] PCT Pub. No.: WO96/34663

PCT Pub. Date: Nov. 7, 1996

[30] Foreign Application Priority Data

May 5, 1995 [GB] United Kingdom ..... 9509256

[51] Int. Cl.[7] ..... A63B 69/36

[52] U.S. Cl. ..... 473/160

[58] Field of Search ..... 473/160, 161, 473/162, 278, 279

[56] References Cited

U.S. PATENT DOCUMENTS

| | | | |
|---|---|---|---|
| 1,612,291 | 12/1926 | Jackson | 473/160 |
| 2,334,540 | 11/1943 | Buffham . | |
| 3,170,694 | 2/1965 | Dolce | 473/160 |
| 3,366,387 | 1/1968 | Koener . | |
| 3,595,581 | 7/1971 | Anderson | 473/161 |
| 3,658,343 | 4/1972 | Rogers et al. . | |
| 3,831,949 | 8/1974 | Henning | 473/160 |
| 4,114,887 | 9/1978 | DelRaso . | |
| 4,211,417 | 7/1980 | Brown | 473/160 |
| 4,222,568 | 9/1980 | Russo . | |
| 4,240,637 | 12/1980 | Cross et al. . | |
| 4,743,027 | 5/1988 | Simjian . | |
| 4,790,534 | 12/1988 | Jamison . | |
| 4,790,535 | 12/1988 | Droske, Jr. . | |
| 4,790,538 | 12/1988 | Gettelfinger . | |
| 4,836,551 | 6/1989 | LaSalle . | |
| 4,874,167 | 10/1989 | Hillard . | |
| 4,875,678 | 10/1989 | Sawyer . | |
| 4,875,684 | 10/1989 | Benilan . | |
| 4,877,250 | 10/1989 | Centafanti . | |
| 4,886,276 | 12/1989 | Digangi et al. . | |
| 4,949,970 | 8/1990 | Calley . | |
| 5,002,280 | 3/1991 | Hines . | |
| 5,123,651 | 6/1992 | Vinciguerra . | |
| 5,172,914 | 12/1992 | Primerano | 473/161 |
| 5,301,947 | 4/1994 | Kim | 473/161 |
| 5,390,925 | 2/1995 | Wiltse | 473/160 |
| 5,733,200 | 3/1998 | Kim | 473/161 |
| 5,863,256 | 1/1999 | MacLean et al. | 473/160 |

FOREIGN PATENT DOCUMENTS

| | | |
|---|---|---|
| 0 097 438 | 1/1984 | European Pat. Off. . |
| 0 279 995 | 8/1988 | European Pat. Off. . |
| 0 336 839 | 10/1989 | European Pat. Off. . |
| 2 217 612 | 11/1989 | United Kingdom . |
| 89/06995 | 8/1989 | WIPO . |

*Primary Examiner*—Mark S. Graham
*Attorney, Agent, or Firm*—Alston & Bird LLP

[57] ABSTRACT

A golf putting green apparatus comprises an elongate putting green surface flexible panel supported on spaced apart elongate side members which are pivotally mounted at an intermediate portion on first support legs. The side members are supported at a putting off end of the apparatus on independently height adjustable second support legs so that as the putting-off end of each side support member is raised or lowered an opposite cantilevered hole end of the side support member is lowered or raised respectively.

17 Claims, 5 Drawing Sheets

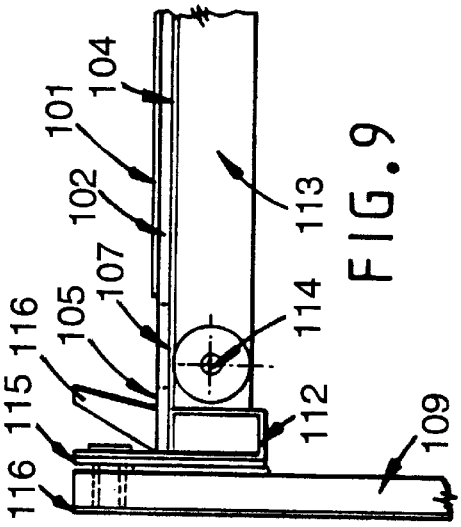
FIG. 9
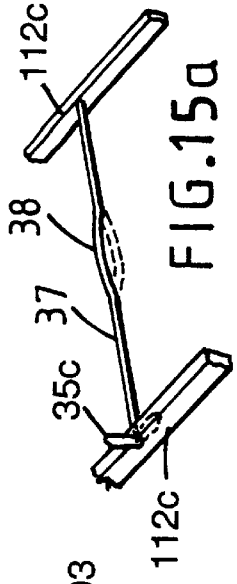
FIG. 15a
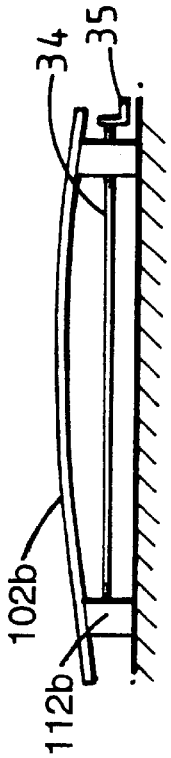
FIG. 15
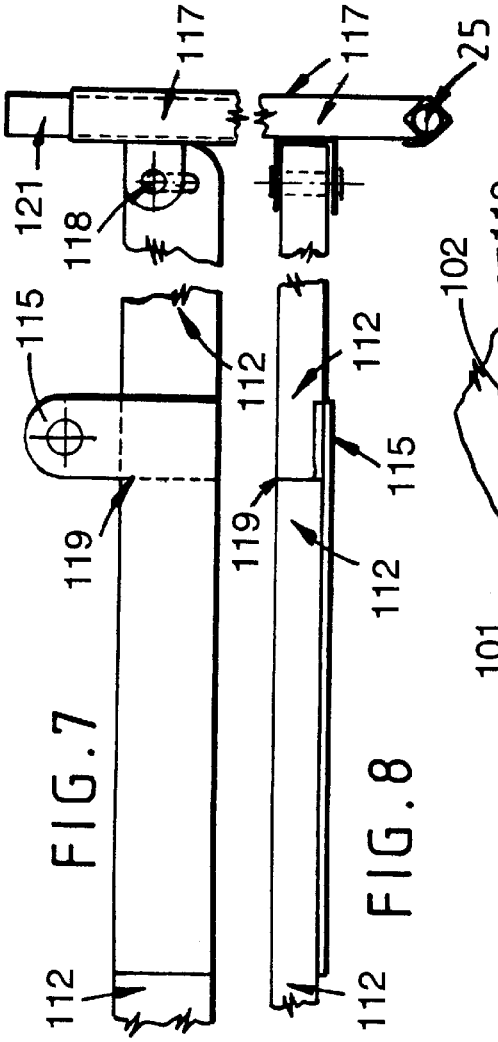
FIG. 7
FIG. 8
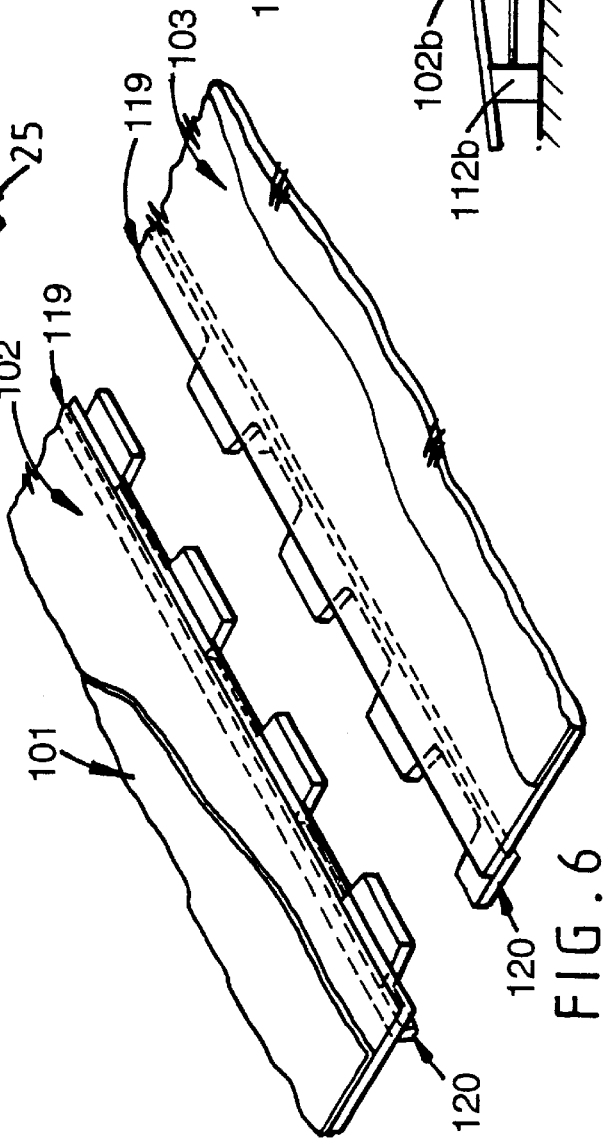
FIG. 6

PUTTING GREEN APPARATUS

FIELD OF THE INVENTION

The present invention relates to a putting green apparatus suitable for use in putting practice, and a putting game which may be played on said apparatus.

BACKGROUND OF THE INVENTION

It has been recognized that good putting is vitally important to successful golfing, and various devices have been previously proposed for use in practising putting. Examples of such known devices include U.S. Pat. No. 4,240,637 (Cross), U.S. Pat. No. 4,114,887 (DelRaso), U.S. Pat. No. 4,222,568 (Russo) and U.S. Pat. No. 4,790,538 (Gettelfinger). In general though these have provided only very poor or unrealistic representations of practical putting conditions and/or have been relatively complex or cumbersome in construction.

SUMMARY OF THE INVENTION

It is an object of the present invention to avoid or minimize one or more of the above disadvantages.

The present invention provides a golf putting green apparatus comprising a putting green surface having a putting-off area and a hole area which putting green surface is provided on a flexible panel means supported on spaced apart elongate generally rigid, at least in use, side members which are pivotally mounted at an intermediate portion on first leg means, and are mounted at the putting-off end on independently height adjustable second leg means so that as the putting-off end of each said side support member is raised or lowered the hole end of said side support member is lowered or raised, respectively, and when the putting-off ends of the side members are supported at different heights, the flexible panel means is twisted between said putting-off and hole ends, whereby adjustment of said height adjustable second leg means provides a variety of pitch and roll putting conditions.

Thus with an apparatus of the present invention a wide variety of substantially realistic putting conditions with different combinations of longitudinal slope (uphill or downhill in the putting direction), and borrow (left or right slope transversely of the putting direction), can be readily selected using a relatively simple and economic form of construction.

In another respect the present invention provides a golf putting green apparatus comprising a putting green surface having a putting-off area and a hole area which putting green surface is provided on a flexible panel means supported on spaced apart elongate generally rigid side members, respective ones of said side members being secured to side edge portions of said flexible panel means, and displacement means formed and arranged for displacement of at least a portion of at least one of said side members towards an opposed side member for deforming said flexible panel means into a curved, convex or concave, shape, whereby displacement of at least a portion of one side member with respect to another opposed side member provides a variety of putting conditions.

Various forms of displacement means may be used including for example a turnbuckle; a wire and pulley system; threaded rods, or a chain link/belt and buckle arrangement for deforming said flexible panel into said curved shape. Preferably said displacement means is provided with means, for example a handle, to manually adjust said displacement so as to vary the degree of curvature of said panel in a convex or concave shape.

As the hole area of the putting green does not require to be load-bearing, this is most conveniently simply supported by cantilevering thereof. If desired though the hole end (or some other part of the hole area) of the panel means could be provided with height adjustable leg means as well.

Preferably there is provided between said side members an elongate rotable member having at least one, desirably a plurality of cam means spaced apart therealong, and a lever means arranged to bring at least one of said cam means into contact with the underside of said flexible panel means so as to raise at least one portion of said putting green surface and thereby to provide a further degree of variety of pitch and roll conditions.

In order to facilitate storage and/or transport of the apparatus, the flexible panel means is conveniently comprised of at least two sections (which may conveniently correspond to the putting-off and hole areas) hingedly connected together and mounted on correspondingly hingedly connected side members. Advantageously the side members are interconnected by a plurality of cross-members pivotally connected at opposite ends to respective ones of said side members to provide additional support to either or both of said putting-off and hole areas of the flexible panel means whilst allowing a degree of independent movement of said side members by means of differential adjustment of the height adjustable leg means.

Where there is used a folding flexible panel means, the hinged connection is desirably at opposite side edges offset forwardly from the rear side of the panel means, and the opposed edge portions of the flexible panel sections are provided at the rear side of the panel means with respective interlocking formations formed and arranged for mutual interlocking in the fully deployed condition of the flexible panel means so as to maintain substantially alignment of said opposed panel section edge portions when said flexible panel means is subjected to twisting.

Preferably the underside of said flexible panel means has a plurality of elongate substantially parallel grooves therein to facilitate curvature, especially convex curvature of the putting surface.

The hole area may be provided with more than one hole at various positions to provide variation in approach distance, direction, and/or pitch and roll conditions relative to a given putting-off position. The putting-off area is also conveniently provided with markings to indicate one or more putting-off positions for similar purposes.

Advantageously the hole area is provided with a ball collection (and optionally return) means for collecting 'holed' balls, and desirably also un-holed balls exiting the hole area. Conveniently these may be in the form of a housing extending underneath and around the free edges of the hole area and may include channel and/or other guide means for directing collected balls to a collecting zone from which they can be conveniently retrieved for re-use, optionally by means of a coin-, token-, card- or other payment- or authorization device- operated control mechanism.

In a further aspect the present invention provides a golf putting game comprising:

a putting green apparatus of the present invention with marking means defining at least one putting-off position and at least one hole, and adjustable height leg control means formed and arranged for defining a plurality of pitch and roll configurations of the flexible panel means; at least one ball, and at least one putter, said game being played by means of playing a series of putts using a plurality of different putting-off position, hole location, and pitch and roll configuration, combinations, and scoring successfully holed putts. Desirably a plurality of different scores is applied to different combinations corresponding to the ease or difficulty of holing a putt with the respective combination.

BRIEF DESCRIPTION OF THE DRAWINGS

Further preferred features and advantages of the invention will appear from the following detailed description given by way of example of some preferred embodiments illustrated with reference to the accompanying drawings in which:

FIG. 6 is a detailed view showing the interlocking means and crossmembers, respectively of the flexible panel means;

FIGS. 7 to 11 are detailed views of the height adjustable legs and control means thereof;

FIG. 15 is a schematic side view of another embodiment of the invention; and FIG. 15*a* is schematic perspective view of another embodiment of the invention.

DETAILED DESCRIPTION OF THE INVENTION

Figure 1:
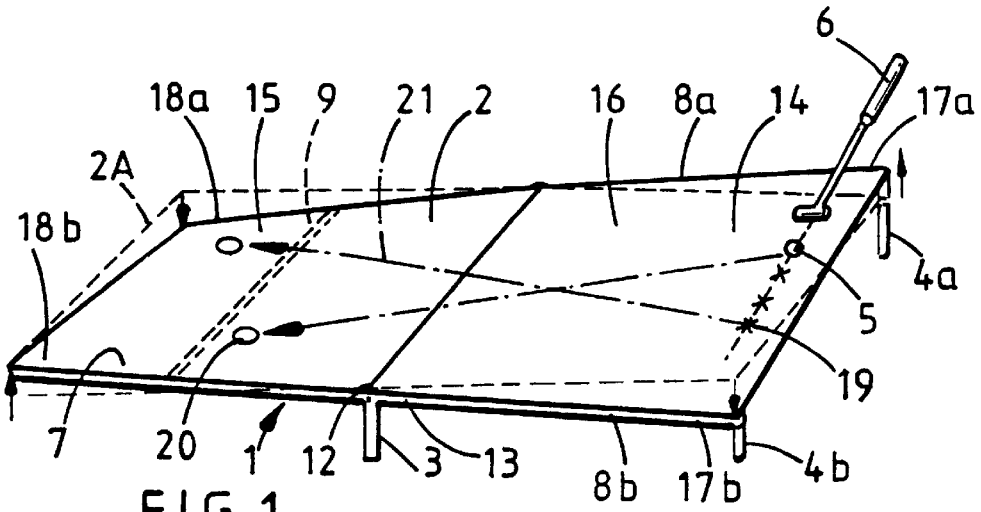
FIG. 1 is a generally schematic perspective view of the principal parts of a putting green apparatus of the present invention.

FIG. 1 shows a golf putting green apparatus 1 comprising a flexible panel 2 mounted on first and second support legs 3, 4, and a golf ball 5 and putter 6. The flexible panel 2 is supported at opposite sides 7 on elongate side members 8 and crossmembers 9 (only one shown) which are pivotally connected 10 (see FIG. 6) at each end 11 to a respective side member 8.

Each side member 8 is pivotally mounted 12 at a generally central portion 13 between a putting-off area 14 and a hole area 15 on a putting green playing surface 16 on the flexible panel 2. The putting-off ends 17 of the side members 8 are mounted on respective ones of the second legs 4 which are independently height adjustable.

The disposition of the flexible panel 2 when entirely horizontal is shown in dashed outline 2A. In FIG. 1 the effective height of the righthand second leg 4*a* has been increased to raise the putting-off end 17*a* of the right-hand side member 8*a* whilst the effective height of the left-hand second leg 4*b* has been reduced to lower the putting-off end 17*b* of the lefthand side member 8*b*. Due to the central pivotal mounting 12 of the side members 8*a*, 8*b*, the cantilevered respective hole ends 18*a*, 18*b* of the right hand and left hand side members 8*a*, 8*b* are correspondingly lowered and raised, respectively. This results in the flexible panel being twisted as shown in FIG. 1 so as to provide a pitch and roll configuration of the playing surface 16 which has a left to right corkscrew character which provides a significant degree of playing difficulty and at the same time provides a substantially realistic simulation of an actual green. (It will incidentally be appreciated that the height variations in FIG. 1 have been exaggerated somewhat for illustrative purposes and would normally be quite small). Thus for example with a typical playing surface area of around 1200 to 1800 mm by 2400 to 4800 mm, the maximum deviation above or below a horizontal level at each adjustable leg height might be in the region of + or −40 mm from the horizontal.

The playing surface 16 is provided with markings defining a plurality of putting-off positions 19 on which a ball 5 may be placed and the flexible panel 2 has a number of holes 20 into which a player attempts to putt the ball 5. This provides a range of different putt length and putting direction combinations indicated by chain line 21, for each pitch and roll configuration.

As shown in FIGS. 2 to 5 'Shoot 18' (TM) putting green apparatus is played on a synthetic grass surface, indicated by reference number 101, which can be varied in texture to represent different putting green surface characteristics. The synthetic grass surface 101 is fixed with self release adhesive to the putting table 102 and laid over the putting platform 103. The putting table 102 contains six putting holes 104 with different coloured sleeves fitted at predetermined positions to accommodate the 'Shoot 18™ Format'. A gutter 105 is formed between the synthetic grass surface 104 and a raised barrier 106 fitted to the periphery of the putting table 102. Drop holes 107, having a diameter greater than that of a golf ball, are positioned at suitable intervals along the course of the gutter 105 to trap spent balls and allow them to drop onto the dual angled collecting base 108 of the putting table housing 109 which directs them into a common collecting box 110 (see FIG. 5). Golf balls entering the putting holes 104 also drop onto the dual angled collecting base 108 and are directed into the common collecting box 110 (see FIG. 5). The synthetic grass surface 101 laid over the putting platform 103 has nine putting -off points 111 positioned in a predetermined layout to accommodate the 'Shoot 18™ Format'. A tray 11*a* is set into the table to house golf balls (not shown) during play and a scoreboard 11*b* is provided behind the tray 11*a* to indicate the sequence of play of the balls in the tray. Each putting-off point 111 consists of a spot encircled by a ring and is formed with two different colours of paint which correspond with two of the six coloured putting hole sleeves 104 fitted within the putting table 102. The paint used to form the putting points 111 is introduced underneath the top surface of the synthetic grass surface 101 in order to maintain the consistency of the synthetic grass top surface 101 when a golf ball passes over the putting points 111.

Figure 7A:
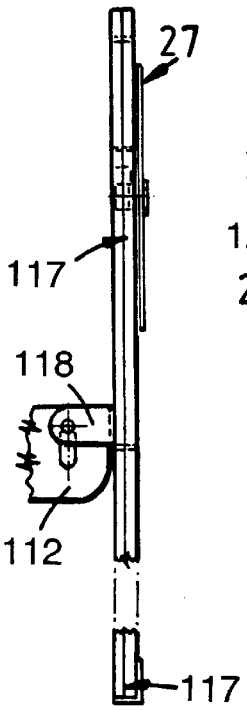
Figure 4:
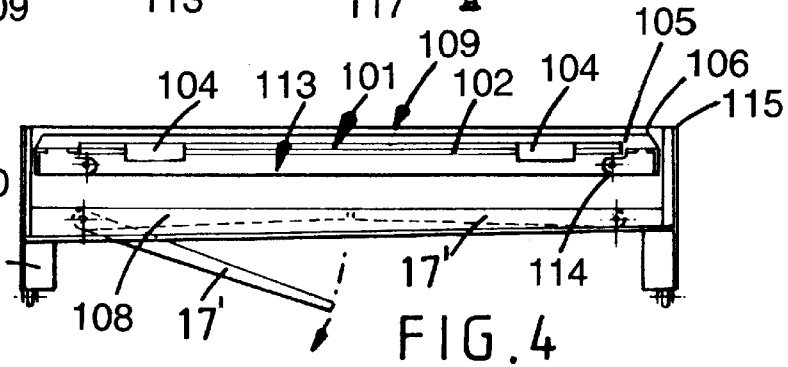
FIG. 4 is a transverse section of the apparatus of FIG. 2 along the axis Y—Y.
Figure 5:
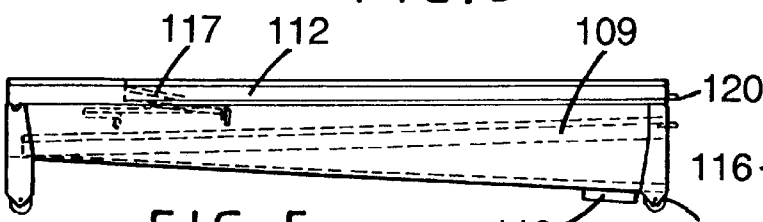
FIG. 5 is a side view of the apparatus of FIG. 2 in a stored configuration.
Figure 12:
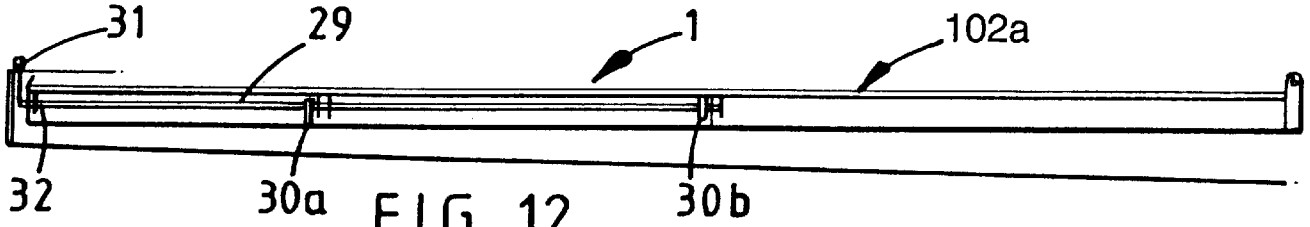
FIGS. 12 to 14 show a further embodiment of the invention.

The putting table 102 and the putting platform 103 comprises two steel main members 112 and support crossmembers 113 fixed to the main members 112 by way of pivoting joints 114. A plywood board e.g. 12 mm plywood, or similar type board/sheet, which forms the putting table 102 and the putting platform 103, is fitted over, and securely fixed to the support crossmembers 113. The putting table 102 and the putting platform 103 are linked together by two pivoting hinges 115 which in turn are fixed to the stationary support legs 116 of the putting table housing 109. The putting platform 103, which accommodates the weight of the player(s), is of a heavier construction than that of the putting table 102 and rests on two independently adjustable legs 117 fitted at the end of the two main members 112 of the putting platform 3 by way of a swivel and lock joint 118 (See FIGS. 6 and 7). This leaves the putting table 102 suspended from the pivoting hinges 115 and floating in mid-air within the putting table housing 109. This in turn pressurises the butting joint face between the putting table 102, the putting platform 103, and their respective main members 112. The butting joint 119 of the putting table 102 and the putting platform 103, is fitted with an interlocking castellated butt strap 120 securely fitted to the underside of the putting table 102 and the putting platform 103. The alternation of each castellation and overlapping between the respective halves of the castellated butt strap 120, helps provide and maintain a level plane and lateral stability for the synthetic grass surface 101. The combination of the pivoting hinges 115 and the castelled butt strap 120 facilitates the folding up of the platform 103 over and onto the top edge of the putting table housing 109. In doing so, the far end of the putting table 102 lowers itself onto the back level point of the collecting base 108 and the putting table housing 109. This facilitates storability and portability of the unit. As shown in FIG. 4 there are provided folding legs 17[1] on the underside of the housing which fold down to support the housing as a table. The flat surface provided on the stored unit provides a useful worksurface.

The whole of the synthetic grass surface 101, fixed to the putting platform 102, and laid over the putting platform 3, can have its horizontal and vertical plane altered to introduce a variety of pitch and roll modes to simulate various types of non-level surfaces encountered on a putting green during short to medium play. This is achieved by way of the two independent adjustable support legs 117 each fixed to the end of each main member 112 by way of a swivel and lock joint 118 which is attached to an inner sliding plate 121 contained within the static sleeve of the adjustable support leg 117 (See FIGS. 7 to 10). The sliding plate 121 is moved in a vertical plane by rotating the control lever 22 (FIG. 10) which moves a profiled cam disc 23 whose periphery defines a plurality of lugs a–e which engage selectively between two wheels 24 which are fixed to the sliding plate 121 and have different offsets from the pivoted axis of the cam disc 23, thereby defining different height settings for the support leg 117. This moves the sliding plate 121, which is guided by ball bearings 25, in a vertical plate. This in turn moves the main members 112, which pivot on the pivoting hinges 115, and cross members 113, of the putting table 102, and the putting platform 103, and ultimately the synthetic grass surface 101, into one of a possible twenty five different putting modes. The twenty five putting modes are programmable by moving the control lever 22 on each of the adjustable legs 117 to each of the program indicators 26*a, b, c, d, e*, set out on the control lever guard 27.

The main modes are as follows:

a-a=level play uphill.

c-c=level play.

e-e=level play downhill.

c-a=level lefthand with borrow right to left uphill.

c-e=level lefthand with borrow right to left downhill.

a-c=level righthand with borrow left to right uphill.

e-c=level righthand with borrow left to right downhill.

a-e=corkscrew right to left, then left to right.

e-a=corkscrew left to right, then right to left.

Substituting program indicators 'a' with 'b' and 'e' with 'd', produces the same modes as above, but less pronounced.

The game can be played singularly, in pairs, and in multiples thereof, or in teams. A total of 36 golf balls are used, 18 yellow, 18 white.

The object of the "Shoot 18"™ game is to shoot the golf balls from putt off points 111 into the respective coloured putting holes 104 with a single stroke using a putter. Only balls that enter their respective coloured putting hole 104 as directed by the colour of spoy, or circle of the putt off point, are counted. Once a ball has stopped moving and remains on the playing area, even is it is on the lip of the putting hole, it must be removed from the playing area. Balls rebounding from the peripheral barrier 106 or the gutter 105, and enters its respective putting hole 104, are discounted. Record the hole putts on a "Shoot 18"™ score board. In competition the player with the highest number of successful putts wins the game/match.

Single Play: The game is played by one person using 18 golf balls. In effect, the person is playing against a pre-selected program (course). The golf balls are played from a 9 point play off grid marked on the synthetic grass surface 101 of the putting platform 103. Play is directed by the symbol and numbered sequence displayed on the score-board layout. Using a putter, the golf balls are played to the coloured putting holes 104 indicated by the correspondingly coloured spot and circle of the play off points 111, thus directing the course of play. The 9 coloured spots are played first (out), and the 9 circles last (in).

Double Play: The game is played by two players using 36 golf balls, 18 coloured yellow and 18 coloured white, played over a pre-selected program (course). The golf balls are played from a 9 point play off grid marked on the synthetic grass surface 101 of the putting platform 103. Play is started from any one of the corner play off points 111, and is progressed in a 'S', or reverse 'S' direction across the gird or as directed by the symbol and numbered sequence displayed on the score board layout. Using a putter, the golf balls are played to the coloured putting holes 104 indicated by the correspondingly coloured spot and circle of the play off points 111, thus directing the course of play. Each of the two persons play each shot from the same play off point 111 in tandem. One plays to the putting holes 104 indicated by the coloured spots, and one plays to the putting holes 104 indicated by the coloured circles over the first 9 putts (out), and crossing over for the second 9 putts (in). The player using the yellow coloured balls always leads. Each player, although putting in tandem from the same putting off point 116, and covering the same course, head to head, has shots that differ in length and direction, thus removing the advantage given to a player following on behind the first player.

Competitive Play: A team comprises of 5 players. Each match will be played over 5 games. Each game will be played in the pre-selected program modes (courses) aa - cc - ee - ae - and ea. Each game will be played by 2 members of the opposing team and played in the same manner as double play.

Figure 2:
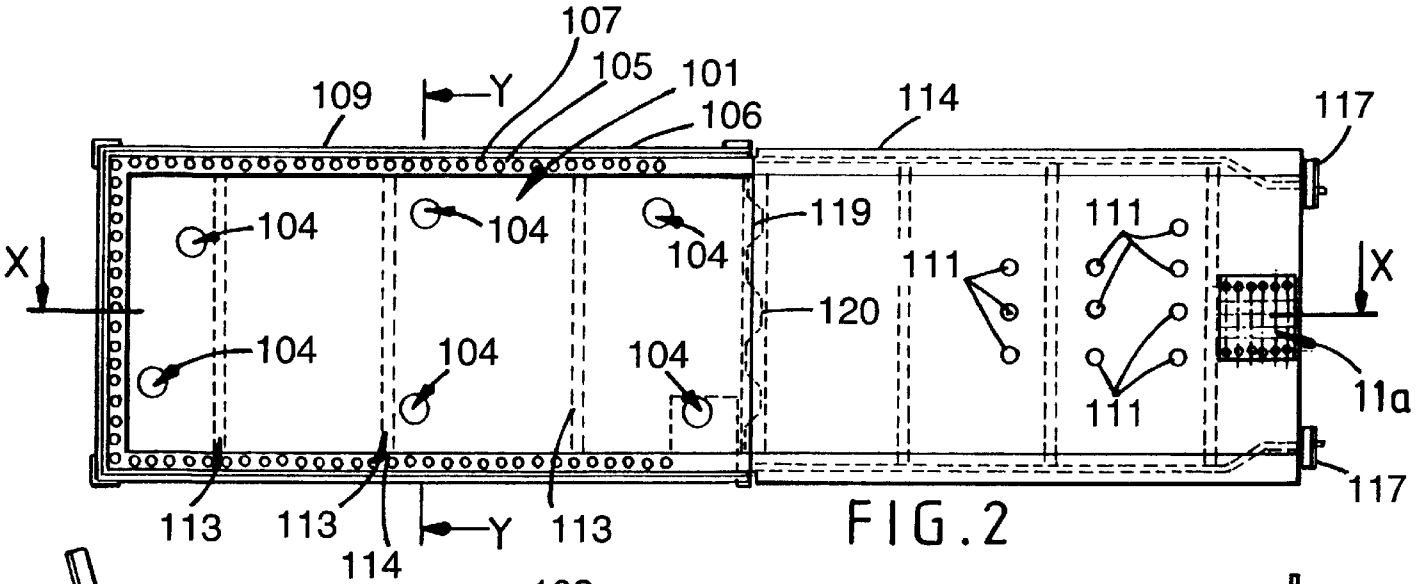
FIG. 2 is a plan view of a complete putting apparatus.
Figure 3:
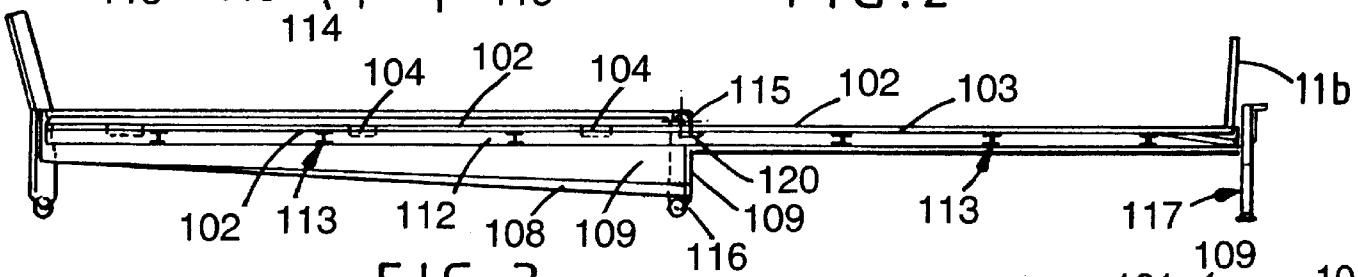
FIG. 3 is a longitudinal section of the apparatus of FIG. 2 along the axis X—X.

The putting table platform as shown in FIG. 2 provides 18 variable length putts, ranging from 12 feet (3657.6 mm) to 3.5 feet (1066.8 mm) in length, increments of 6 inches (152.4 mm). From the starting point, indicated in FIG. 1 and following a reverse 'S' across the grid, starting on the 9 spots, and returning on the 9 circles at the cross over the putting sequence and distance is as follows:

| | | | | | | | |
|---|---|---|---|---|---|---|---|
| 1 | Black | Spot | to | Black | Hole | 9'6" | (2895.6 mm) |
| 2 | Blue | Spot | to | Blue | Hole | 3'6" | (1066.8 mm) |
| 3 | White | Spot | to | White | Hole | 7'0" | (2133.6 mm) |
| 4 | Brown | Spot | to | Brown | Hole | 11'0" | (3352.8 mm) |
| 5 | Yellow | Spot | to | Yellow | Hole | 5'0" | (1524.0 mm) |
| 6 | Red | Spot | to | Red | Hole | 7'6" | (2286.0 mm) |
| 7 | Black | Spot | to | Black | Hole | 11'6" | (3805.2 mm) |

-continued

| | | | | | | | |
|---|---|---|---|---|---|---|---|
| 8 | Blue | Spot | to | Blue | Hole | 5'6" | (1676.4 mm) |
| 9 | White | Spot | to | White | Hole | 9'0" | (2743.2 mm) |
| 10 | Brown | Circle | to | Brown | Hole | 12'0" | (3657.6 mm) |
| 11 | Yellow | Circle | to | Yellow | Hole | 6'0" | (1828.8 mm) |
| 12 | Red | Circle | to | Red | Hole | 8'6" | (2590.8 mm) |
| 13 | Black | Circle | to | Black | Hole | 10'6" | (3200.4 mm) |
| 14 | Blue | Circle | to | Blue | Hole | 4'6" | (1371.6 mm) |
| 15 | white | Circle | to | white | Hole | 8'0" | (2438.4 mm) |
| 16 | Brown | Circle | to | Brown | Hole | 10'0" | (3048 mm) |
| 17 | Yellow | Circle | to | yellow | Hole | 4'0" | (1219.2 mm) |
| 18 | Red | Circle | to | Red | Hole | 6'6" | (1981.2 mm) |

In the case of double play, the second player follows the same course, in tandem, starting on the circles and returning on the spots.

Figure 10:
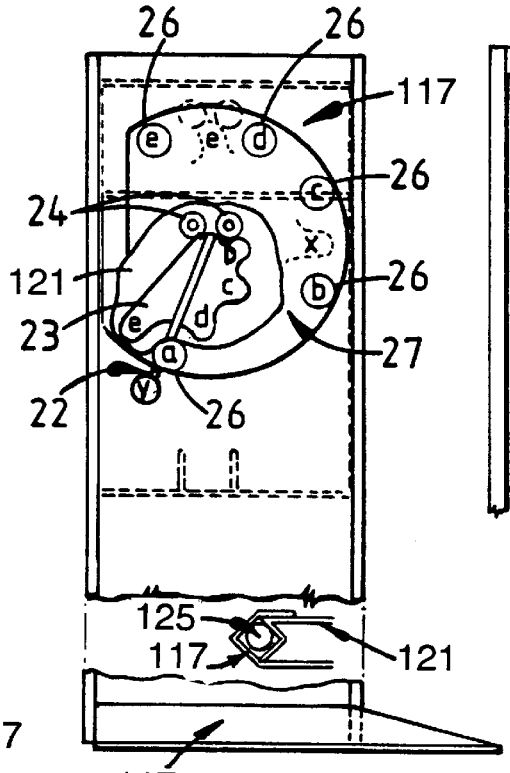

The adjustable leg mechanism, in FIG. 10 controls the pitch and roll of the whole putting surface 101 shown in FIG. 2. The cam 23, with 5 variable points a, b, c, d and e, in each of the two hinged adjustable legs 117, at the rear of the putting platform 113, controls and programmes 25 different modes as follows:

a a, a b, a c, a d, a e,
b a, b b, b c, b d, b e,
c a, c b, c c, c d, c e,
d a, d b, d c, d d, d e,
e a, e b, e c, e d, e e,

It will be appreciated that various modifications may be made to the above described embodiment without departing from the scope of the present invention. Thus instead of a purely mechanical height adjustment system there could be used electrically and/or pressurized fluid e.g. hydraulically operated height adjustment means for controlling the pitch or angle of inclination of the side members relative to the horizontal. The height adjustment system need not moreover by exclusively mounted on the second legs but could for example be mounted for acting between the side members and the first legs.

Figure 11:
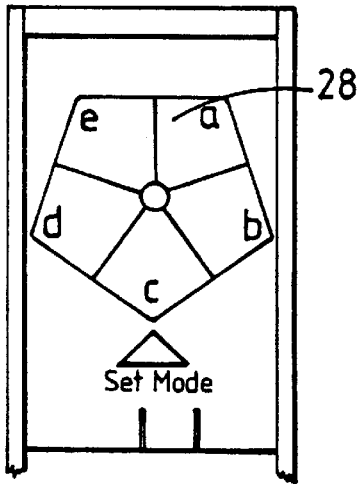

An additional element of play involves the introduction of two pentagonal discs attached by a centralised spindle fitted to each of the telescopic legs 117. Each point of the respective pentagonal disc 28 is marked a, b, c, d and e, see FIG. 11. Prior to each shot being taken, each disc is spun by the player. On arrestment of discs the letter indicated on the lowest positioned point of the pentagon is selected on the control lever indicator of the telescopic leg. This alters the mode of the course for each shot and introduces an element of luck/chance.

The score-board 11*b* referred to is mounted behind the ball tray located at the rear of the putting platform, and in the main, consists of two sets of 18 hinged discs which directs the player around the 18 putting points and in turn indicates the score pattern as the discs are turned face down when a putt is missed, thus leaving the putted shots showing on the score-board.

Random Play

Random Play can be introduced into single, double and competitive play by altering the mode of the (course) before each shot is played. Prior to playing each shot the player will spin each of the pentagonal discs 28 mounted on each adjustable support leg. Each point of the pentagonal discs 28 has a mode letter a, b, c, d and e. On each arrestment the letter at the lowest point of a pentagonal disc is selected on the programmable control lever of the respective adjustable support legs, thus introducing a chance element into the playing of 'Shoot 18'.

Figure 13:
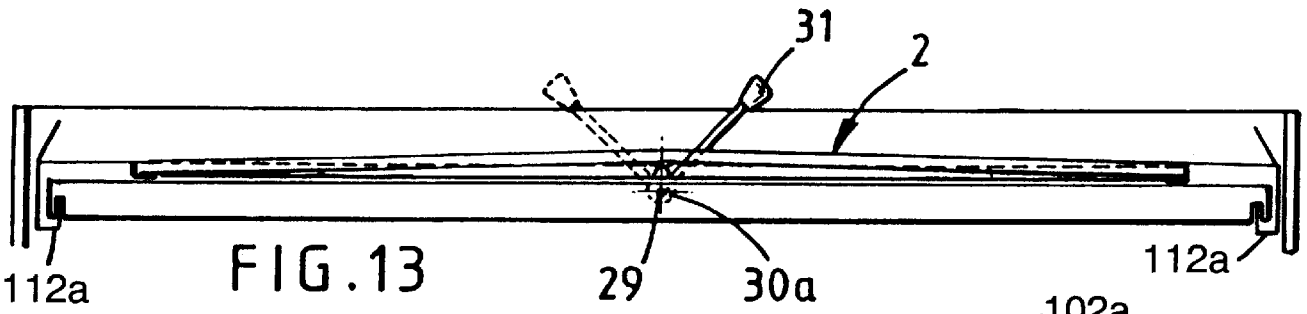
Figure 14:
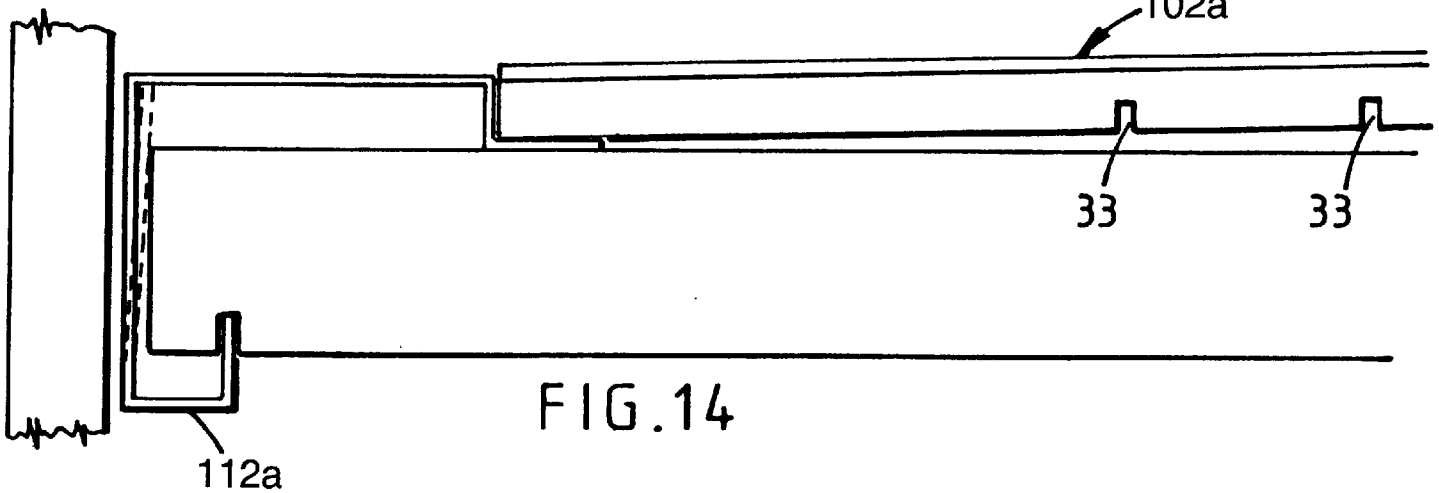

FIGS. 12 to 14 and FIG. 15 show two further embodiments of the apparatus of the invention, generally similar to that described above, which includes an elongate connecting rod 29 which extends along the middle of the apparatus between the side members 112*a*. The rod 29 has two spaced apart and off set cams 30*a, b* along its length and a lever 31 at one end 32 which rotates the rod and brings one or other of the cams 30*a, b* into contact with the underside of the putting table 102*a* so as to cause the table 2 to become convex (see FIG. 13). As shown in FIG. 14 the underside of the table has several elongate grooves 33 which facilitates the flexing/curvature of the table.

FIG. 15 is a schematic side view of a further embodiment of the invention which comprises a flexible table 102*b* secured to two spaced apart elongate side members 112*b*. A turnbuckle 34 adjustable by a handle 35 enables displacement of one side member with respect to another and thereby deforming the flexible table 102*b* into a convex (as shown) or concave shape.

FIG. 15*a* is a perspective view of another embodiment of the invention which comprises a flexible table (not shown) which is secured to two spaced apart elongate side members 12 as in FIG. 13. An elongate rod 37 having an arcuately offset central portion 38 constituting a cam means is rotatable by a handle 35 to displace the flexible table supported thereby to a greater or lesser degree into a more or less convex shape.

Figure 16:
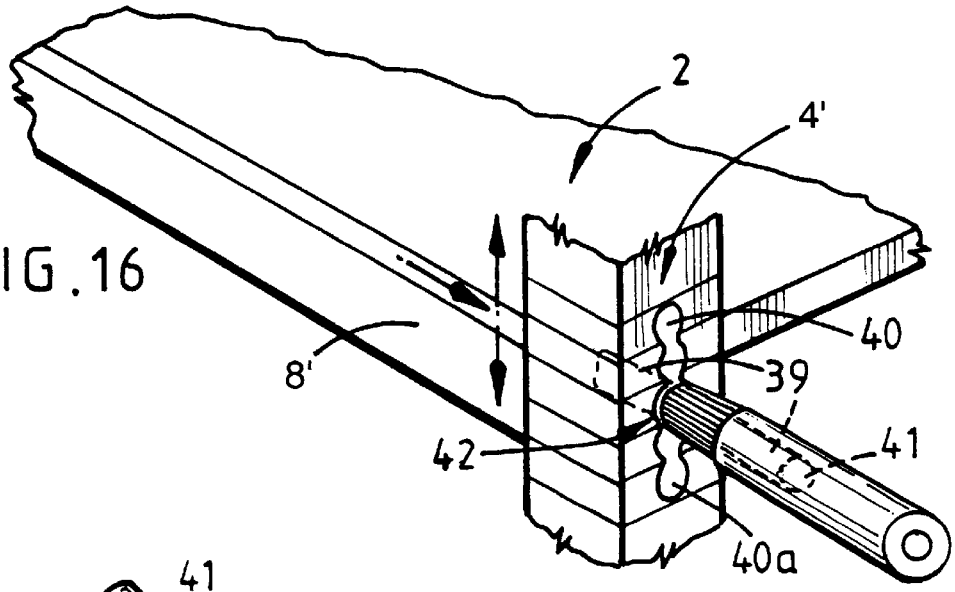
FIGS. 16 and 17 show respectively two different embodiments of support leg 4 suitable for use with the apparatus shown in FIG. 1.

FIG. 16 shows a perspective view of a height adjustable support leg 4' for use with the apparatus of the invention. The positioning of the panel 2 with respect to the support leg 4' allows for the effective height of the panel to be adjusted. The panel 2 is supported on side members 8' and the side member 8' has an elongate pin 39 (shown in broken line) which extends through an elongate slot 40 made up of a series of interconnected holes 40*a*. A handle 41 on the end of the pin 39 has a collar portion 42 formed and arranged to be received by each one of said holes 40*a*. The handle 41 is axially displaceable along the pin 39 such that when the handle 41 is pulled back the collar portion 42 disengages from the selected hole so as to allow the pin and thus the panel 2 to move up and/or down with respect to the support leg. Each one of the holes on the support leg may be colour coded or suitable marked e.g. with numbers/letters so that the respective corner of the panel 2 may be adjusted in height according to the rules of the game.

Figure 17:
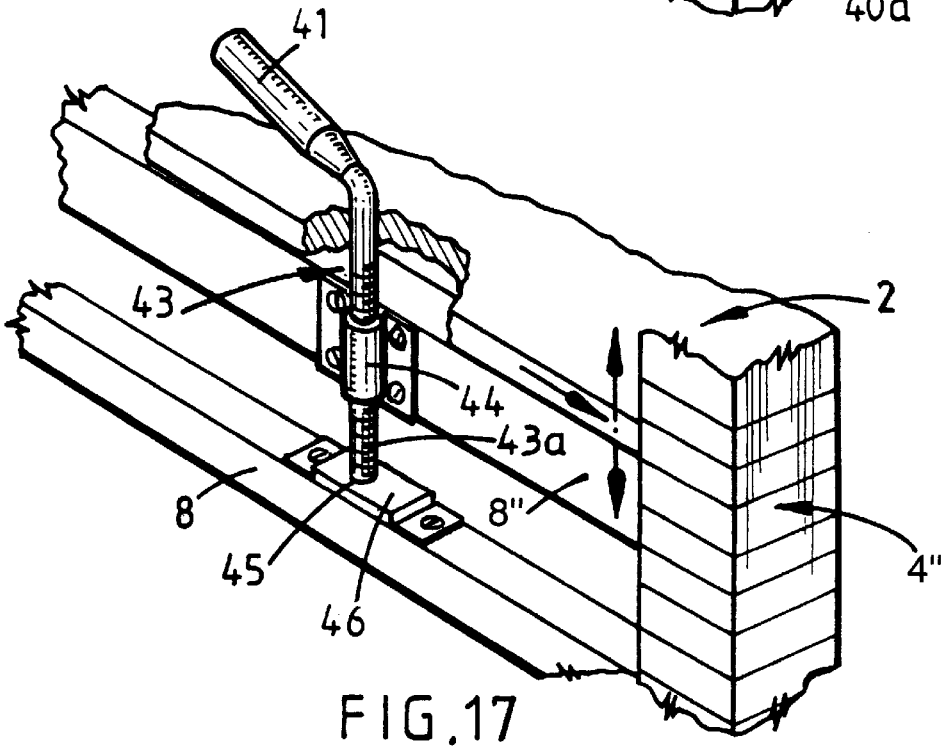

FIG. 17 shows a perspective view of a further embodiment of height adjustable support leg 4". In this embodiment a jack means 43 has a handle 41 and an elongate male threaded portion 43*a* screwed into a female threaded portion 44 fixed to the side member 8". The bottom portion 45 of the threaded portion 43*a* abuts against a plate 46 fixed to the base of the apparatus. Rotation of the handle 41 causes the side member 8" and thus the corner of the support panel 2 to be vertically displaced with respect to the support leg 4 and thus for the height of the corner of the panel 2 with respect to the support leg 4 to be adjusted. As in the embodiment described above with reference to FIG. 16 the support leg may be provided with colour coding or other suitable markings so that the panel may be adjusted in height according to the rules of the game.

What is claimed is:

1. A golf putting green apparatus comprising a flexible panel means comprising opposite first and second ends, a putting-off surface proximate said first end, and a hole-defining surface proximate said second end, wherein said flexible panel means is supported on laterally spaced apart elongate generally rigid side members which provide a substantially continuous support along substantially the whole length of said flexible panel means, wherein each of said side members comprises a putting-off end, a hole end opposite from said putting-off end, and an intermediate portion between said putting-off end and said hole end, wherein each of said side members is pivotally mounted at said intermediate portion of said side member on first leg means, wherein each of said side members is mounted at said putting-off end of said side member on height adjustable second leg means so that as the putting-off end of each side member is raised or lowered the hole end of said side member is lowered or raised respectively, and wherein said height adjustable second leg means are capable of being height-adjusted independently of one another so that the putting-off ends of the side members are capable of being supported at different heights so that the flexible panel means is twisted between said putting-off and hole ends of said side members, whereby adjustment of said height adjustable second leg means provides a variety of pitch and roll putting conditions.

2. An apparatus according to claim 1 wherein each of said height adjustable second leg means comprises a jack means operative for displacing the respective said hole end of the respective and side member upwardly and downwardly.

3. An apparatus according to claim 1 wherein each of said height adjustable second leg means comprises a pin member extending from a respective said side member and a generally vertically extending engagement member having a plurality of space apart engagement portions selectively engageable thereby for supporting said side members at different heights.

4. An apparatus according to claim 1 wherein each of said height adjustable second leg means comprises a cam means and a cam follower means operatively arranged so that rotation of said cam means drives said cam follower means for supporting said side members at different heights.

5. An apparatus according to claim 1 wherein each of said side members is hingedly connected together, said flexible panel means comprises at least two sections hingedly connected together and mounted correspondingly on said hingedly connected side members, and said apparatus further comprises stop means formed and arranged for restricting hinged movement of said sections and said side members so as to allow said flexible panel means to be folded up together when not in use while restricting the range of hinging movement of said sections of said flexible panel means and side members when said flexible panel means is opened out from its folded up state so that said side members provide said substantially continuous support along substantially the whole length of said flexible panel means.

6. An apparatus according to claim 1 further comprising a plurality of cross members, wherein each cross-member has opposite ends pivotally connected to respective ones of said side members to provide additional support to at least one of said putting-off and hole-defining surfaces of said flexible panel means.

7. An apparatus according to claim 1 further comprising a displacement means formed and arranged for displacing at least a portion of said flexible panel means so that said flexible panel means defines a curved shape.

8. An apparatus according to claim 7 wherein said flexible panel means comprises an underside and said displacement means is in the form of a cam means engageable in use with the underside of said flexible panel means.

9. An apparatus according to claim 7 wherein said flexible panel means comprises an underside and said displacement means comprises engagement members disposed at opposed side portions of the underside of said flexible panel, and said displacement means is operative for moving said engagement members towards each other for deforming said flexible panel means into a curved, convex or concave shape.

10. An apparatus according to claim 1 further comprising a plurality of cross members, wherein each cross-member has opposite ends pivotally connected to respective ones of said side members to provide additional support to at least one of said putting-off and hole-defining surfaces of said flexible panel means.

11. An apparatus according to claim 1 wherein said hole-defining surface defines more than one hole.

12. An apparatus according to claim 1 wherein said putting-off surface is provided with markings to indicate at least one putting-off position.

13. An apparatus according to claim 1 wherein said putting-off surface includes a player support area.

14. An apparatus according to claim 1 wherein the hole-defining surface of said flexible panel means is supported by said side members.

15. An apparatus according to claim 5 wherein said flexible panel means has two said sections hingedly connected together for hinging about said intermediate portions of said side members.

16. A golf putting green apparatus comprising:

a flexible panel means having a putting green surface thereon with a putting-off area and a hole area;

laterally space apart, elongate, and generally rigid side members providing substantially continuous support along substantially the whole length of said flexible panel means;

said side members each having a putting-off end and a hole end;

first leg means formed and arranged for pivotally supporting said laterally spaced apart side members at an intermediate position along the length thereof;

independently height adjustable second leg means for supporting said side members at the putting-off end thereof; and said hole ends of said side members being supported substantially wholly in cantilevered manner beyond said first leg means so that when the support height of each said independently height adjustable second leg means is increased or decreased thereby raising or lowering the corresponding putting-off end of said side member attached thereto, there is obtained a corresponding lowering or raising of the cantilevered end of the respective side member;

whereby said flexible panel means is twisted between the putting-off and hole ends by torsion produced between said side members when the support height of respective second adjustable legs is set at different relative heights, resulting in the corresponding putting-off ends thereby also being supported at different heights.

17. A golf putting green apparatus comprising a flexible panel means supported on laterally spaced apart, elongate and generally rigid side members, and a putting green surface including a putting-off area and a hole area, said side members being formed and arranged so as to provide a substantially continuous support along substantially the whole length of said flexible panel means, said side members being mounted on support means consisting essentially of first leg means and independently height adjustable second leg means, said side members being pivotally mounted at an intermediate portion on said first leg means, said side members being mounted at a putting-off end of said side members on said independently height adjustable second leg means, said side members being substantially unsupported at a hole end of said side members so that as the putting-off end of each side member is raised or lowered the hole end of said side member is lowered or raised respectively, and when the putting-off ends of the side members are supported at different heights, the flexible panel means is twisted between said putting-off and hole ends, whereby adjustment of said height adjustable second leg means provides a variety of pitch and roll putting conditions.

* * * * *

UNITED STATES PATENT AND TRADEMARK OFFICE
CERTIFICATE OF CORRECTION

PATENT NO. : 6,146,284

DATED : November 14, 2000

INVENTOR(S) : Russell

It is certified that error appears in the above-identified patent and that said Letters Patent is hereby corrected as shown below:

Column 9, line 27, "and", first occurrence, should read --said--; line 32, "space" should read --spaced--.

Column 10, line 31, "space" should read --spaced--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*